US008562495B2

(12) United States Patent
Ladd et al.

(10) Patent No.: US 8,562,495 B2
(45) Date of Patent: Oct. 22, 2013

(54) UPPER BODY EXERCISE APPARATUS FOR STATIONARY BIKE

(75) Inventors: Holly Ladd, Rainbow City, AL (US); David Ladd, Rainbow City, AL (US)

(73) Assignee: HD Enterprises, LLC, Rainbow City, AL (US)

( * ) Notice: Subject to any disclaimer, the term of this patent is extended or adjusted under 35 U.S.C. 154(b) by 226 days.

(21) Appl. No.: 13/112,380

(22) Filed: May 20, 2011

(65) Prior Publication Data

US 2011/0287910 A1 Nov. 24, 2011

Related U.S. Application Data

(60) Provisional application No. 61/347,135, filed on May 21, 2010.

(51) Int. Cl.
*A63B 21/045* (2006.01)
*A63B 21/00* (2006.01)

(52) U.S. Cl.
USPC ..... 482/127; 482/133

(58) Field of Classification Search
USPC ..... 482/51, 54–65, 70, 72, 116, 121–122, 482/126–127, 71, 133
See application file for complete search history.

(56) References Cited

U.S. PATENT DOCUMENTS 4,740,001 A * 4/1988 Torleumke ..... 280/11.115
5,226,867 A * 7/1993 Beal ..... 482/127
5,304,104 A * 4/1994 Chi ..... 482/1
5,584,783 A 12/1996 Hagg et al.
6,042,516 A * 3/2000 Norton ..... 482/54
6,315,701 B1 * 11/2001 Shifferaw ..... 482/114
7,524,272 B2 * 4/2009 Bruck et al. ..... 482/127
7,695,411 B2 4/2010 Pandozy
7,775,943 B2 8/2010 Vittone et al.
2002/0025891 A1 * 2/2002 Colosky, Jr. et al. ..... 482/127
2005/0159276 A1 * 7/2005 Falcone ..... 482/123
2005/0202938 A1 * 9/2005 Goldberg ..... 482/57
2008/0119333 A1 * 5/2008 Bowser ..... 482/62
2009/0036276 A1 * 2/2009 Loach ..... 482/72
2010/0062915 A1 * 3/2010 Lasala ..... 482/127
2010/0204023 A1 * 8/2010 Mills et al. ..... 482/121

* cited by examiner

*Primary Examiner* — Oren Ginsberg
*Assistant Examiner* — Andrew S Lo
(74) *Attorney, Agent, or Firm* — Dale J. Ream

(57) ABSTRACT

An upper body exercise apparatus includes a spring positioned in a housing interior area. First and second cables have respective first ends operatively coupled to the spring and respective second ends extending away from the housing. Respective movements of the first and second cables away from the housing cause the spring to move toward a biased configuration. The exercise apparatus includes a transmission configured such that an outward movement of the first cable in the absence of an outward movement of the second cable causes all of the springs resistance to be transmitted to the first cable, an outward movement of the second cable in the absence of movement of the first cable causes all of the spring's resistance to be transmitted to the second cable, and an outward movement by both cables causes the spring's resistance to be distributed equally between the first and second cables.

4 Claims, 7 Drawing Sheets

UPPER BODY EXERCISE APPARATUS FOR STATIONARY BIKE

REFERENCE TO RELATED APPLICATIONS

This application is a non-provisional patent application that claims the benefit of Provisional patent application Ser. No. 61/347,135 filed on May 21, 2010 titled Cycling Bike Attachments and Method of Use Thereof. The provisional application is incorporated herein by reference.

BACKGROUND OF THE INVENTION

This invention relates generally to upper body exercise equipment and, more particularly, to a resistance type upper body exercise apparatus configured for attachment to a stationary bicycle exercise device so that a user may exercise both his upper and lower body without mounting and/or dismounting the stationary bicycle.

Using a stationary bicycle exercising device is a popular form of exercise and is useful for working one's legs as well as for cardiovascular exercise. In order to provide a more rounded or balanced workout including the upper body, a user sometimes uses resistance devices such as exercise tubes, spring devices, or actual weights.

Although utilizing a stationary bicycle for lower body exercise and resistance devices for upper body exercise are both effective for their intended purposes, obtaining a full body workout requires a user to repeatedly mount and dismount the stationary bicycle. In other words, a user may ride the bicycle for a period of time, then dismount and use the upper body resistance bands, and then repeat these steps again and again. Unfortunately, individuals who participate in this type of exercise identify the repeated mounting and/or dismounting as the most dislike part of their exercise routine.

Therefore, it would be desirable to have an upper body resistance-type exercise apparatus configured for attachment to a traditional stationary bicycle such that both the upper and lower body may be exercised without mounting and dismounting the bicycle. Further, it would be desirable to have an upper body resistance-type exercise apparatus that provides multiple degrees of resistance that are selectable by a user while riding the stationary bicycle.

SUMMARY OF THE INVENTION

An upper body exercise apparatus according to a preferred embodiment of the present invention includes a housing defining an interior area and a spring in the interior area. First and second cables have respective first ends operatively coupled to the spring and respective second ends extending away from the housing. Respective movements of the first and second cables away from the housing cause the spring to move toward a biased configuration. The exercise apparatus includes a transmission configured such that an outward movement of the first cable in the absence of an outward movement of the second cable causes all of the spring's resistance/bias to be transmitted to the first cable, an outward movement of the second cable in the absence of movement of the first cable causes all of the spring's resistance/bias to be transmitted to the second cable, and an outward movement by both first and second cables causes the spring's resistance to be distributed equally between the first and second cables.

Therefore, a general object of this invention is to provide an upper body exercise apparatus configured for attachment to a stationary bicycle so that a user may exercise both upper and lower body members without mounting and/or dismounting the bicycle.

Another object of this invention is to provide an upper body exercise apparatus that is selectively attached to a stationary bicycle, as aforesaid, that provides resistance type upper body exercise.

Still another object of this invention is to provide an upper body exercise apparatus that is selectively attached to a stationary bicycle, as aforesaid, in which the degree of weight resistance is determined by whether a user engages one hand versus both hands.

Yet another object of this invention is to provide an upper body exercise apparatus that is selectively attached to a stationary bicycle, as aforesaid, in which a degree of resistance is determined by a selector switch.

A further object of this invention is to provide an upper body exercise apparatus that is selectively attached to a stationary bicycle, as aforesaid, that is cost effective to manufacture.

A still further object of this invention is to provide an upper body exercise apparatus that is selectively attached to a stationary bicycle, as aforesaid, that is user-friendly to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
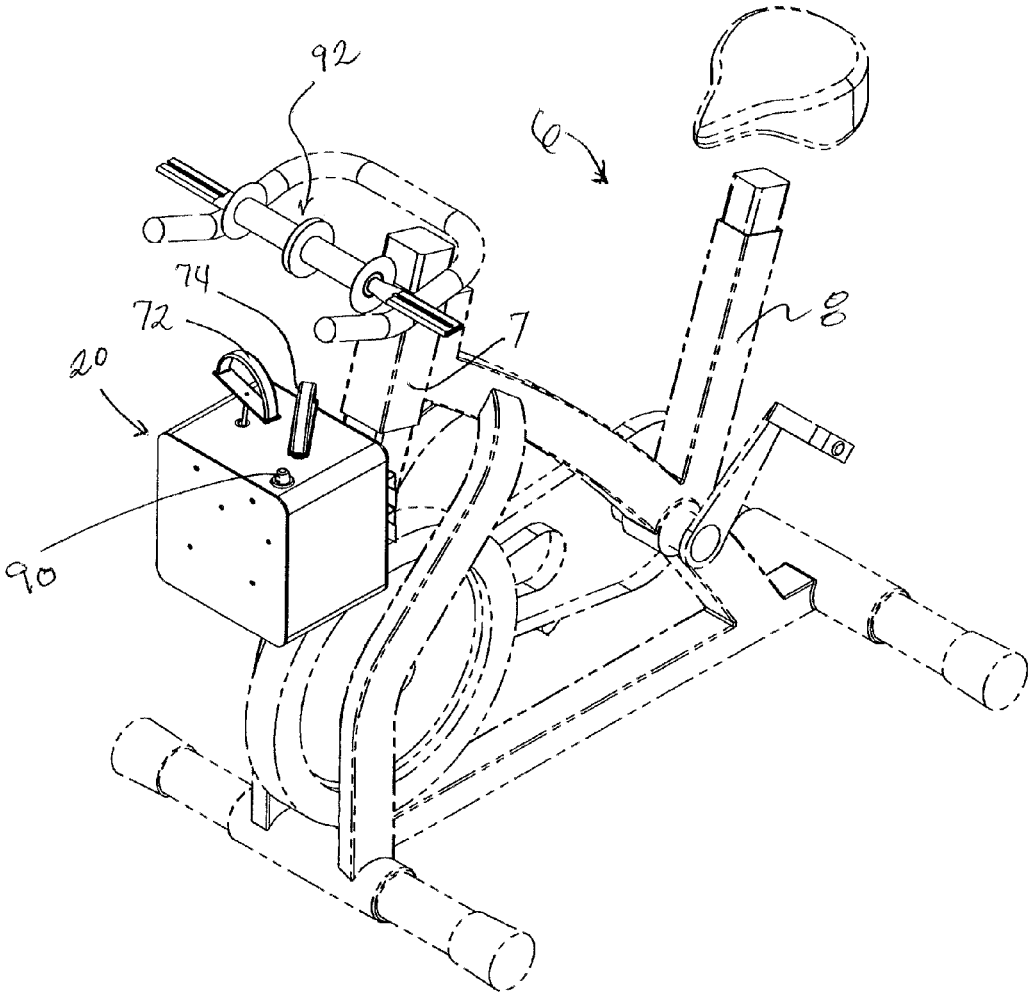
FIG. 1 is a perspective view of an upper body exercise apparatus according to a preferred embodiment of the present invention, in use with a stationary bicycle.
Figure 2:
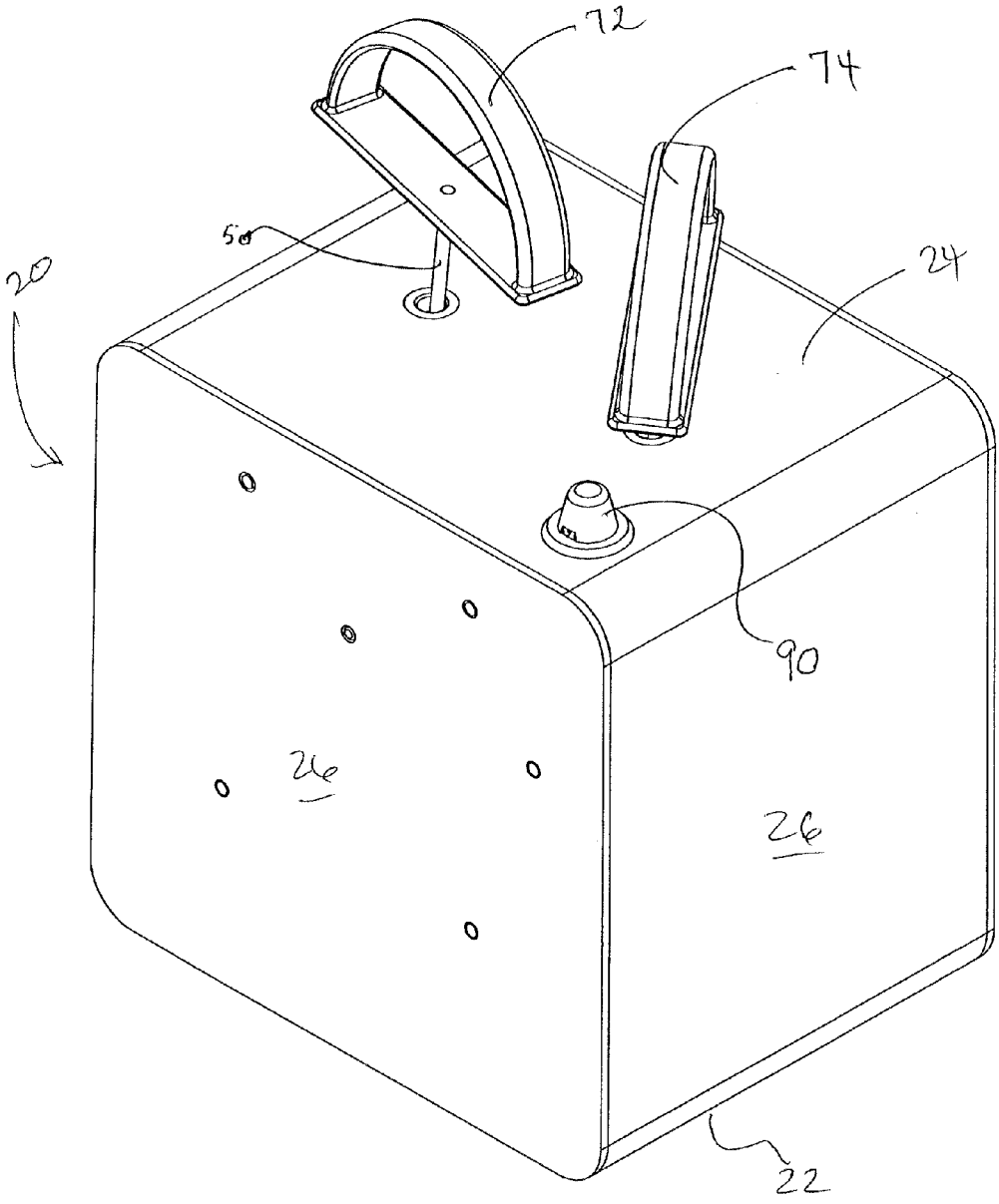
FIG. 2 is a perspective view of the exercise apparatus as in FIG. 1 removed from the stationary bicycle.

An upper body exercise apparatus configured to be attached to a stationary bicycle according to a preferred embodiment of the present invention will now be described with reference to FIGS. 1 to 7 of the accompanying drawings. The upper body exercise apparatus 10 includes a housing 20, a resistance device 30, first 50 and second 60 cables extending from the housing 20, and a transmission 40 situated in the housing 20 and operatively coupled to the spring 30 and cables 50 and 60.

Figure 4:
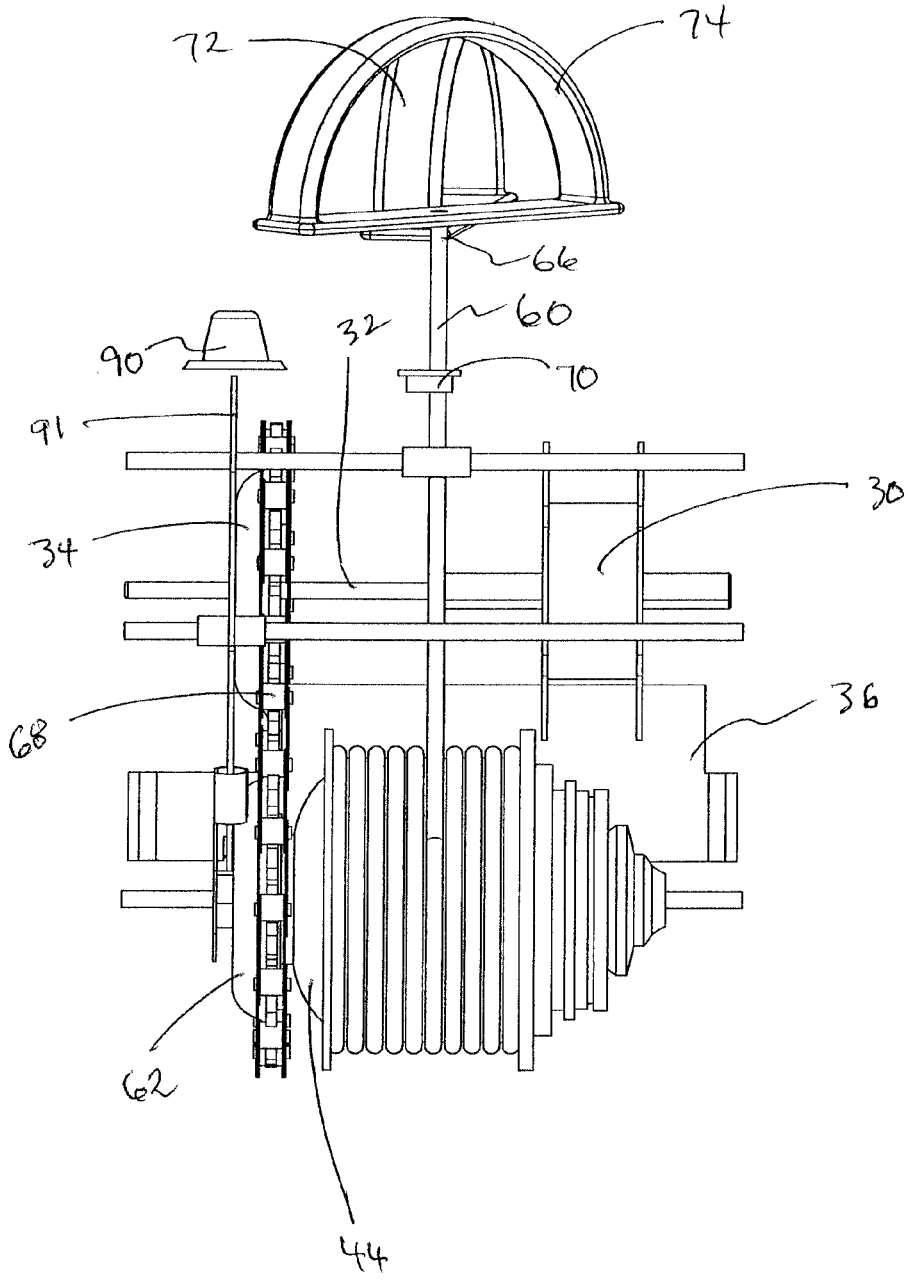
FIG. 4 is a side view of the exercise apparatus as in FIG. 3.
Figure 5:
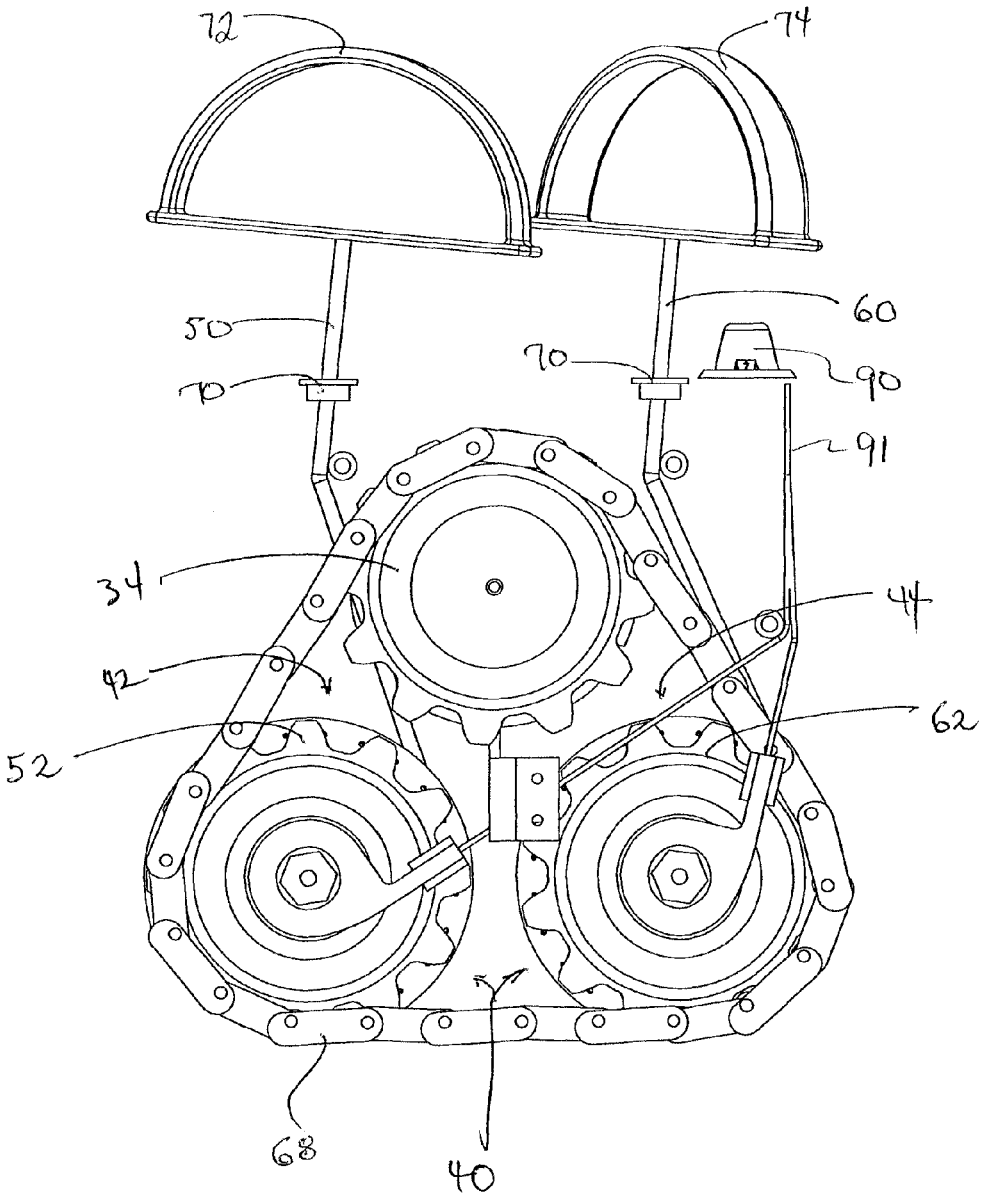
FIG. 5 is a front view of the exercise apparatus as in FIG. 3.
Figure 6:
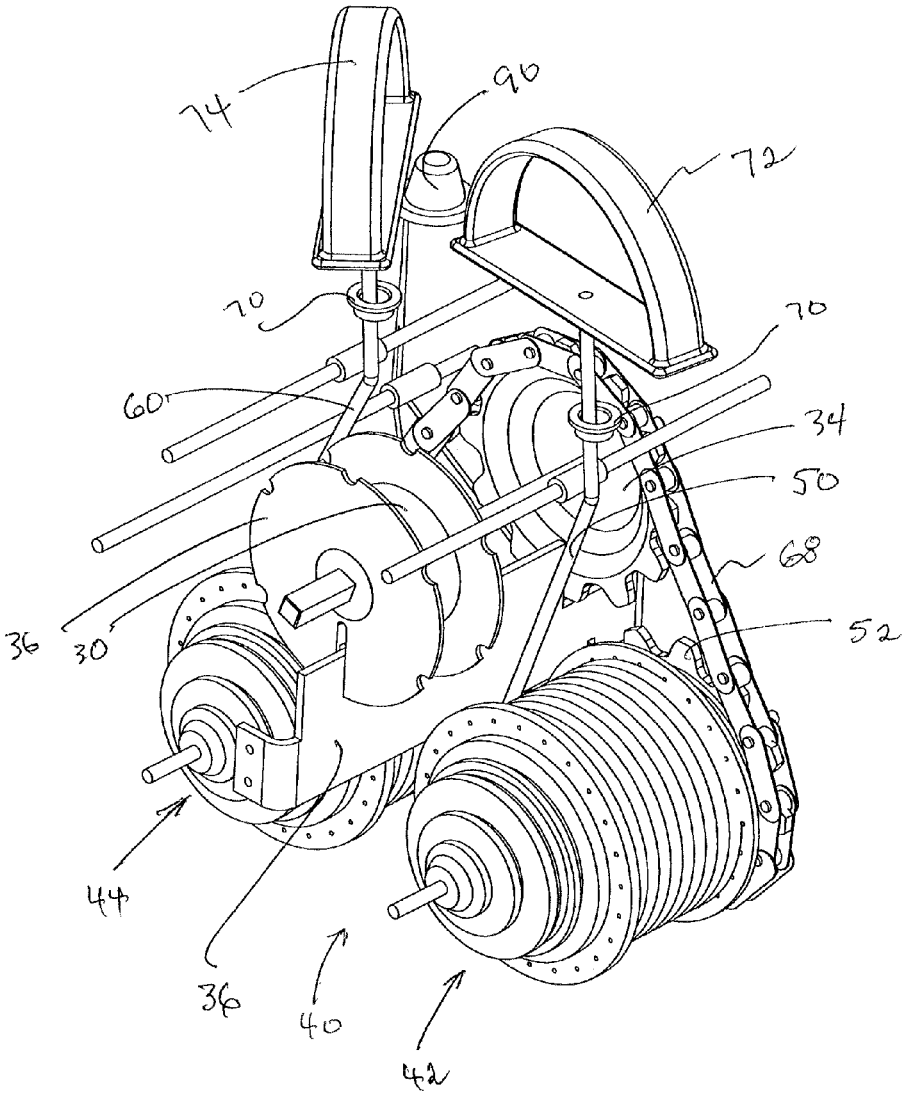
FIG. 6 is a perspective view of the exercise apparatus from a reverse angle.

The housing 20 includes a bottom 22, a top 24, and upstanding side walls 26 that together define an interior area. Although a generally box-shaped housing is shown in the accompanying drawings, it is understood that other configurations would also work. A resistance device, such as a spring 30, may be positioned in the housing interior area. Preferably, the spring 30 includes a steel or other metal construction that is wound about a spool or axle 32 (FIG. 4). The end of the axle 32 opposite the spring 30 is coupled to a spring sprocket 34. It is by rotation of the spring sprocket 34 that the spring 30 is tightened/biased. It is understood that the spring 30 may be bounded by fixed frame structures 36 that do not rotate with the axle 32 and spring sprocket 34.

The resistance device (spring) 30 is naturally in a generally unbiased state. In other words, the spring 30 is normally not attempting to unwind but, rather, is already in its most relaxed state. Stated another way, the resistance device 30 provides resistance when tightened/biased upon pulling the handles 72, 74 and cables 50, 60 as will be described in more detail later. The spring 30 then returns naturally to its unbiased relaxed condition when the cables are relaxed and returned to their unextended configurations. By contrast, operation of the transmission 40 causes the spring 30 to tighten or, in other words, to become biased. As the spring 30 winds or is tightened/biased, resistance is experienced as will be further explained below.

Figure 3:
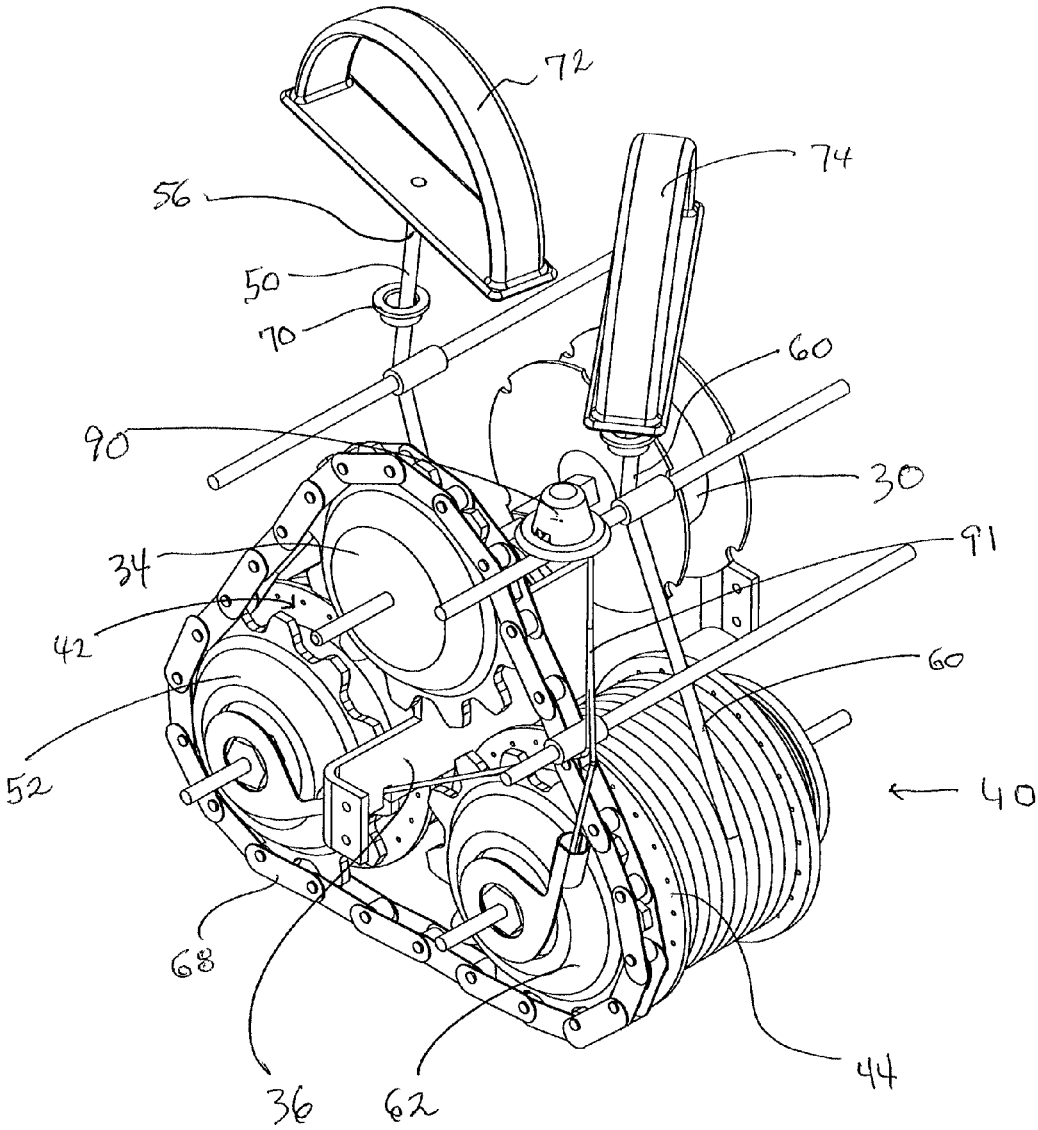
FIG. 3 is a perspective view of the exercise apparatus with the housing removed.

The transmission 40 generally refers to the structure situated in the housing 20 for regulating the amount of resistance applied by the spring 30 or other resistance device to each of the first 50 and second 60 cables. More particularly, the transmission includes a first gear train 42 and a second gear train 44 positioned in the housing 20 adjacent to one another and to the resistance device 30 (FIG. 3). Each gear train 42, 44 includes a respective sprocket 52, 62 configured to coupled respective gear trains to the spring 30. Preferably, each gear train 42, 44 is an epicyclic gear train having a plurality of gears (not shown) inside a respective casing. An epicyclic gear train is configured to provide multiple resistance options without the use of chains (by contrast to a traditional bicycle gearing system). Each epicyclic gear train also includes a ratchet that allows "free-wheeling." In other words, a gear train may be disengaged from the respective sprocket when the associated cable is not engaged, as will be further described below.

The first 50 and second 60 cables each include a first end connected to the first 42 and second 44 gear trains, respectively. Each cable 50, 60 further includes an opposed second end 56, 66 that extends upwardly through the top 24 of the housing 20 and away from the housing 20. The cables 50, 60 may extend through bushings 70. Handles 72, 74, such as D-ring handles, may be connected to second ends 56, 66 of respective cables to be grasped by a user in use. An upward pulling force upon a cable causes a rotational movement of a respective gear train and associated sprocket. As the sprockets are coupled together by a chain 68 or similar fastener, the cables are operatively coupled to the spring 30. A movement of one or both of the gear train sprockets 52, 62 causes the spring sprocket 34 to rotate and the spring 30 to be tightened/biased. Depending on the gear setting, the spring's resistance is translated through the respective cable to the user pulling on the cable.

It is understood, however, that if only a single cable is pulled, the gear train associated with the cable not pulled will "free-wheel" by action of the ratchet and, in that case, the resistance of the spring 30 is not translated to the unpulled cable. More particularly, the gear train associated with an unpulled cable will not engage its associated sprocket and will not operatively engage with the spring. Thus, no resistance from the spring is translated to the unpulled cable; rather all of the spring's resistance is translated to the pulled cable.

The upper body exercise apparatus 10 may also include a gear shifting assembly, also referred to as an input 90. The input 90 may be a dial or a lever having multiple gear selection settings, such as from 1$^{st}$ gear to 10th gear or low/med/high or the like. The input 90 may be mounted atop the housing 20 or adjacent thereto. The gear shifting assembly may include its own cabling 91 operatively connecting the input 90 with respective gear trains 42, 44. With epicyclic gear trains, gears may be shifted while the gears are stationary. Preferably, the gear trains used for the present inventions may include 8 distinct settings, ranging from about 12 pounds of resistance down to about 3 pounds of resistance if a single cable is pulled. It is understood, however, that if both cables are pulled simultaneously, each cable will experience half as much resistance than if only a single cable is pulled.

Figure 7:
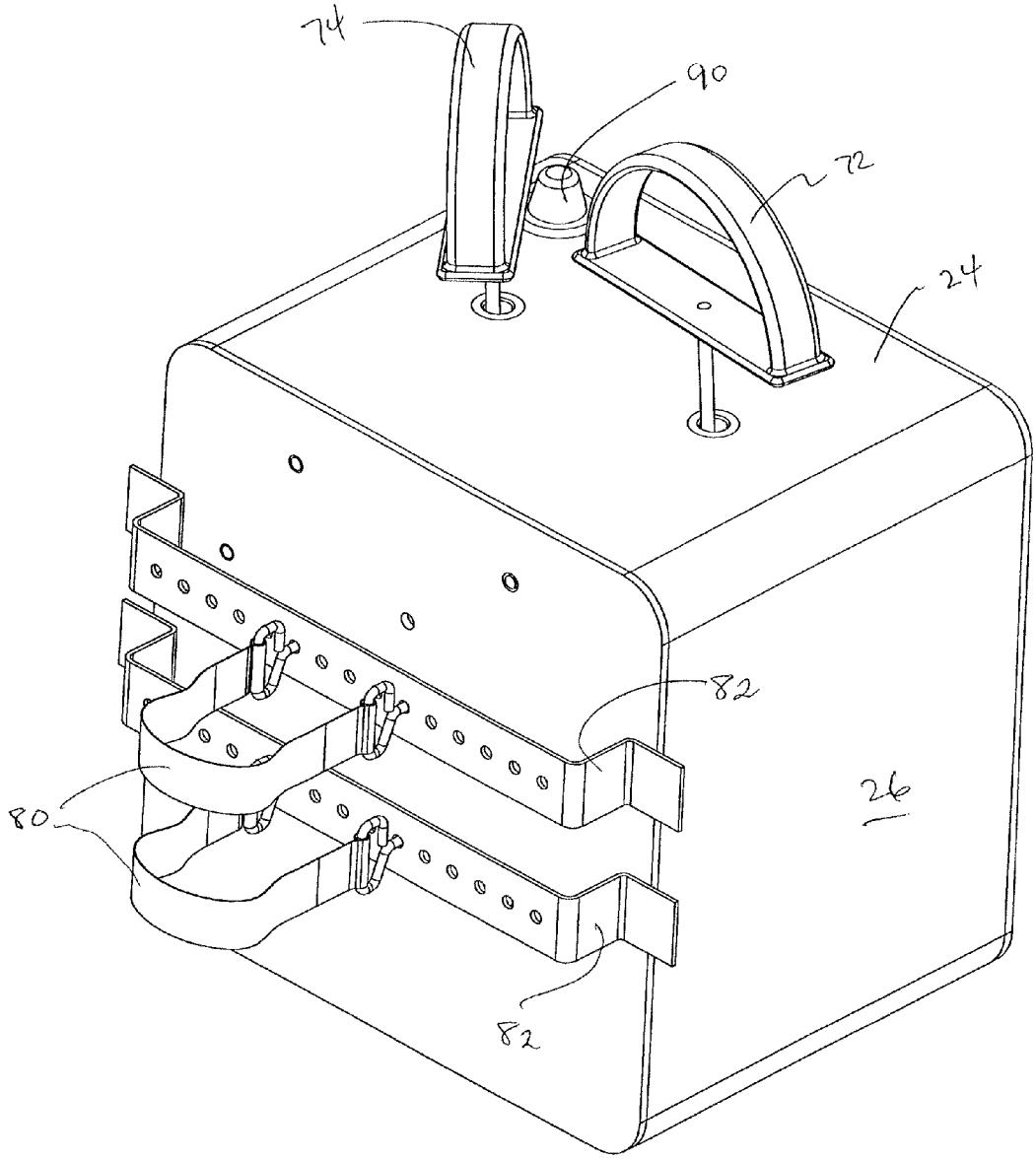
FIG. 7 is a perspective view of the exercise apparatus as in FIG. 2 from another angle.
Figure 1:
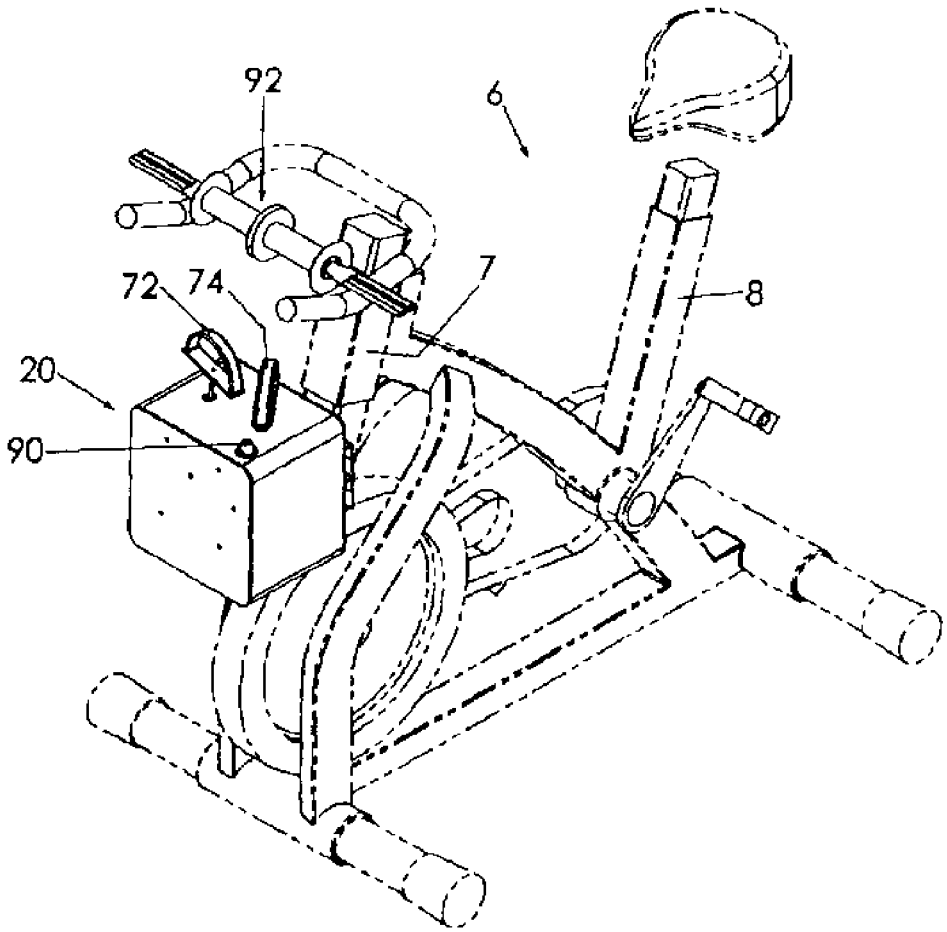
Figure 2:
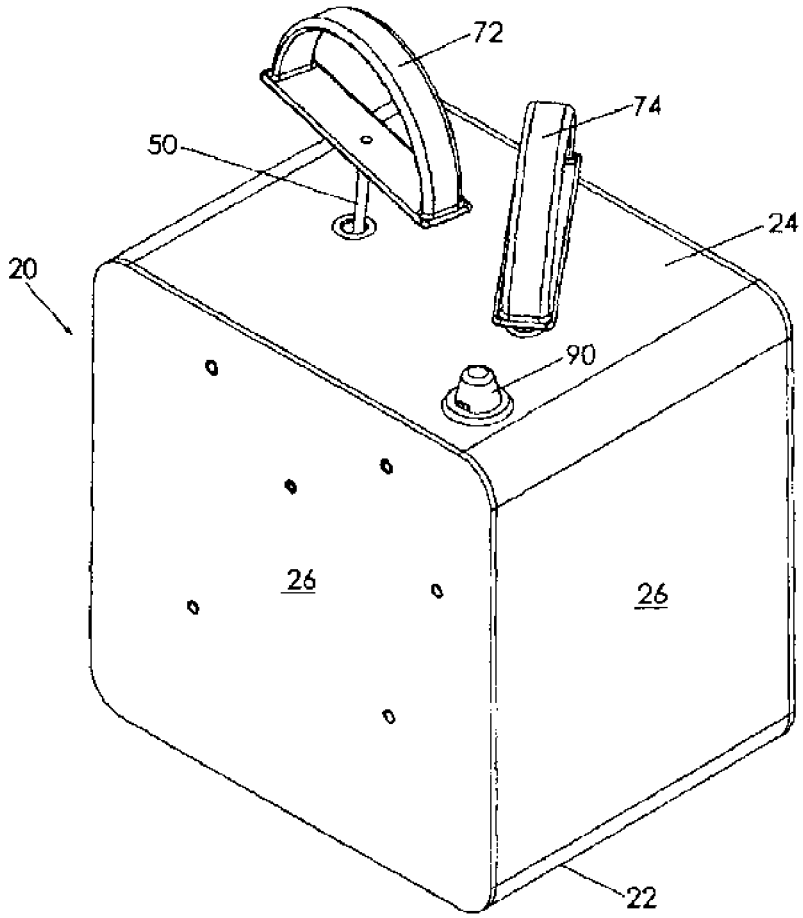
Figure 3:
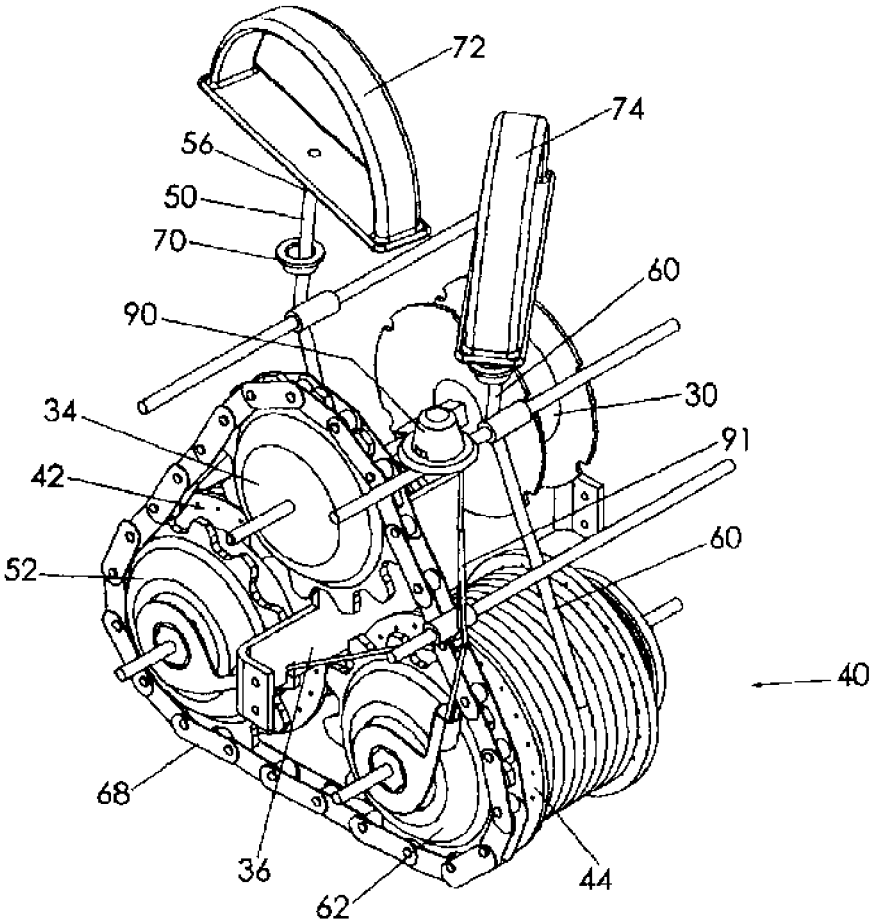
Figure 4:
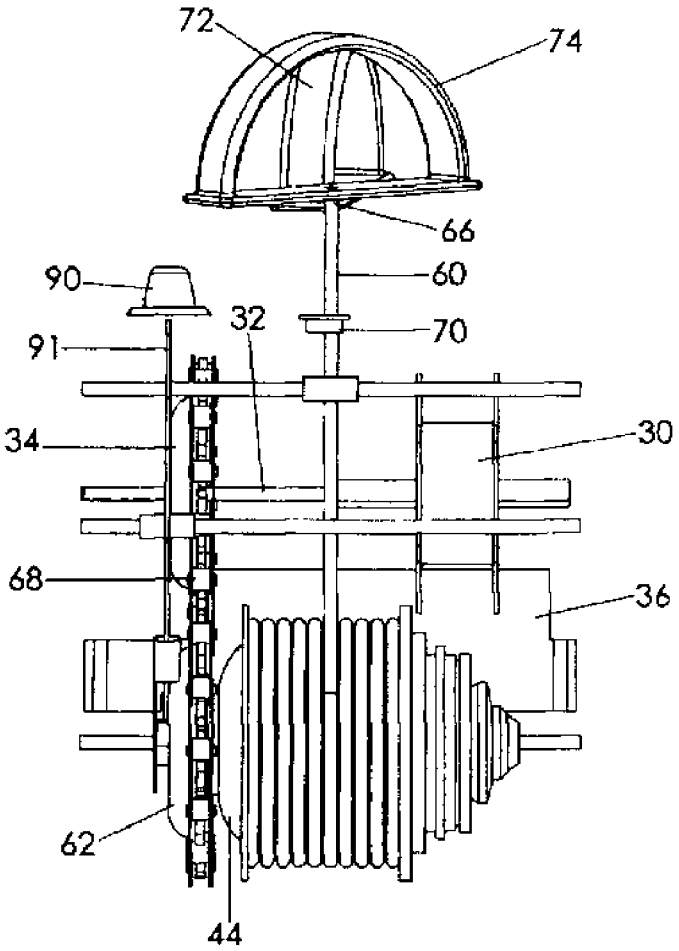
Figure 5:
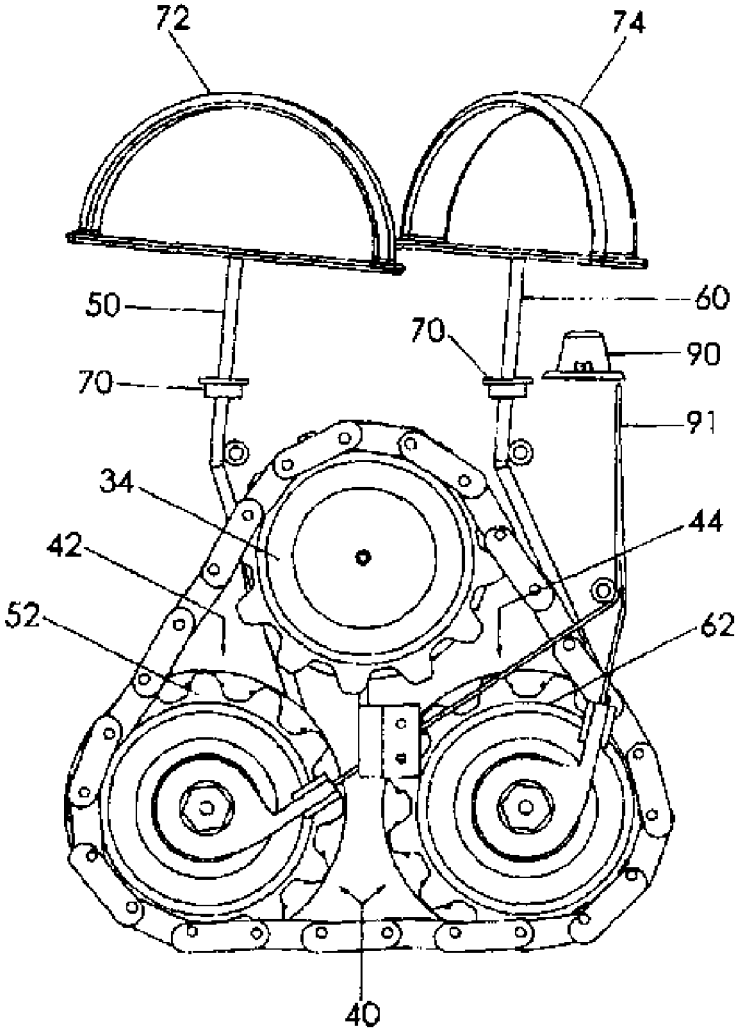
Figure 6:
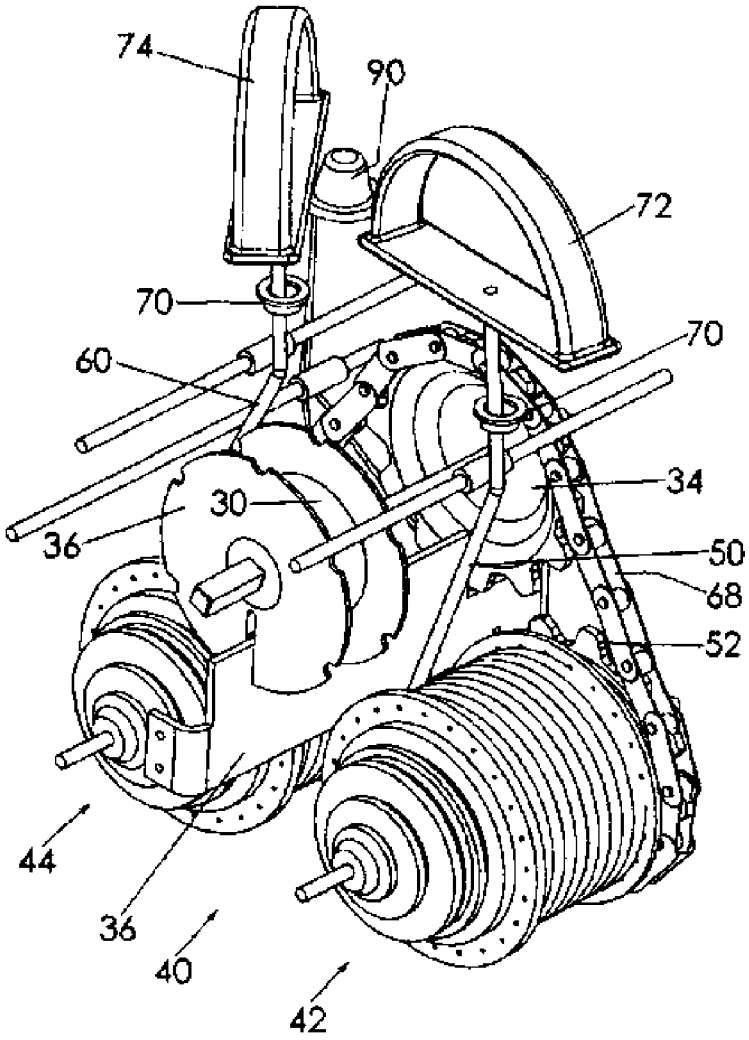
Figure 7:
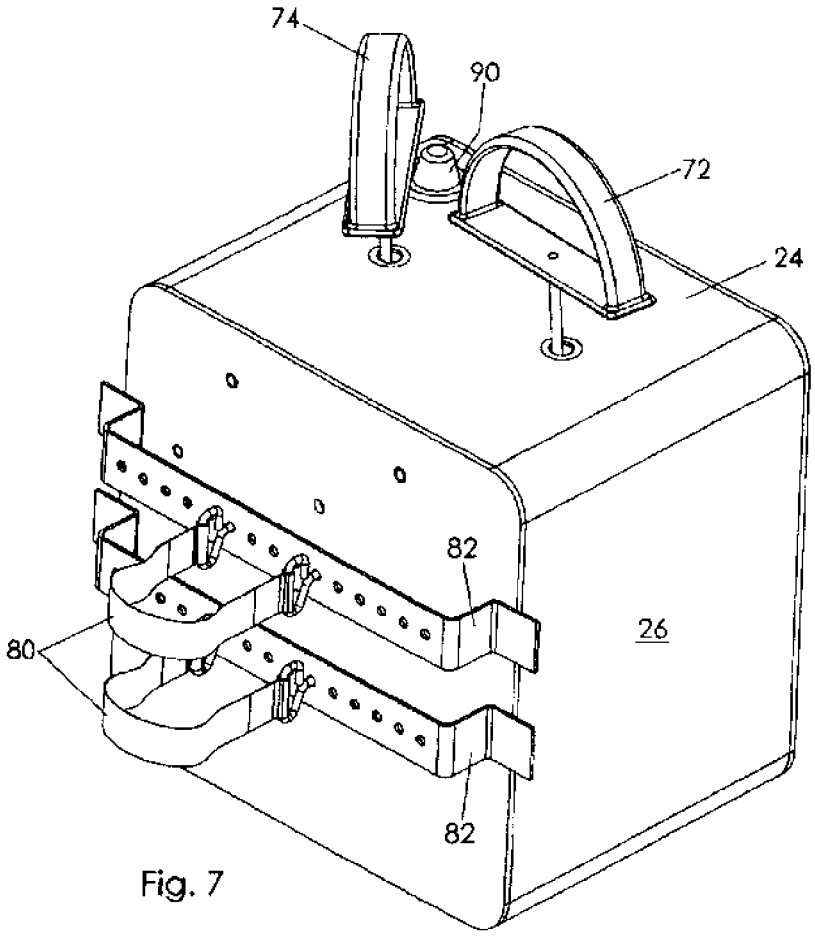

Further, the upper body exercise apparatus 10 may include one or more means configured to attach the housing 20 to a stationary bicycle 6. More particularly, one or more straps 80 may be operatively coupled to a side wall of the housing 20 (FIG. 7). The straps 80 are configured to be secured around a front 7 or rear 8 frame support member of a stationary bicycle (FIG. 1). The straps 80 may be elastic so as to hold the housing 20 without adjustment or may include tightness settings similar to a belt. In addition, the mounting means may include a rigid mounting member 82 defining a plurality of holes through which fasteners may be inserted into the framework of the stationary bicycle 6 (FIG. 7). It may be advantageous to use the straps 80 to temporarily secure the housing 20 to the bicycle until the mounting member 82 may be secured in a more permanent configuration.

The upper body exercise apparatus 10 may also include a cable guide assembly 92 that may be mounted to or positioned on a stationary bicycle 6 and configured to prevent the cables 50, 60 from rubbing against the handlebars during use (FIG. 1). More particularly, the cable guide assembly 92 may include rollers or shielding members having rounded edges to guide cables 50 and 60 as handles 72 and 74 are pulled from the housing 20 in use of the apparatus 10.

In use, the upper body exercise apparatus 10 may be mounted to a stationary bicycle 6 by first attaching its straps 80 to a bicycle support member 7, 8. Then, once positioned as desired, the housing 20 may be more securely affixed by inserting fasteners through the mounting member 82 and into the bicycle support member. The upper body exercise apparatus 10 is immediately ready for use. While riding the stationary bicycle in a traditional manner or when taking a break from pedaling, a user may grasp one or more handles 72, 74 and pull upward, rearward, or in motions that exercise various muscle groups of the upper body. The degree of resistance provided when pulling against the cables 50, 60 is dependent on the gear setting of the input 90 (a.k.a. gear shift assembly). As a cable is pulled, an attached gear train is actuated to rotate, causing an associated sprocket to rotate. Rotation of a gear train sprocket causes the spring 30 to tighten/bias and that resistance is translated to the respective cable. As described above, a gear train is disengaged from its sprocket if its associated cable is not pulled while the other cable is engaged.

As described in more detail above, the resistance provided by the spring 30 when one or both cables 50, 60 are actuated is dependent on the gear settings of each gear train 42, 44. Even more particularly, the resistance provided to each cable 50, 60 depends on whether only one cable is actuated or whether both are actuated together. For example, if the gear input 90 is set on the maximum resistance setting and only a single cable is pulled (i.e. single arm exercise), then all of the resistance of the biased spring 30, e.g. 12 lbs. of resistance, is distributed to the actuated cable. By contrast, if both cables 50, 60 are actuated simultaneously, then the 12 lbs. of resistance is distributed evenly to the two cables, e.g. 6 lbs. of resistance to each cable. The shift assembly input 90 may be adjusted by the user to increase or decrease the resistance.

It is understood that while a spring resistance member is shown and described herein, other resistance devices may also work, as was described in detail with reference to the embodiment shown the provisional application incorporated herein by reference, such as elastic bands, rubber bands, exercise tubes, or metal discs. More particularly, the resistance device may include one or more exercise tubes mounted to a housing or tray that is selectively coupled to a frame member of the stationary bicycle. It is understood that a plurality of exercise tubes would be needed to provide different degrees or "gears" of resistance. Springs such as leaf, coil, or spiral springs made of plastic, metal, or rubber may be used. The resistance device may also include hydraulics, pneumatics, weights and pulleys, or other leverage devices, magnets, electromagnets, or an electric motor.

It is also contemplated that the tension device may be attached to several locations of a stationary bike such as the handle bar post, seat post, external locations such as door frames or the like. If pulleys are used, they may be coupled to the handle bars, handle bar posts, seat posts, or external locations. It is understood that the exercise apparatus described herein or its alternative as described above may be mounted externally, i.e. not mounted to a stationary bicycle and used for upper body exercises.

Accordingly, the upper body exercise apparatus 10 provides a solution to the problem of having to repeatedly mount and/or dismount a stationary bicycle in order to get an upper body resistance workout.

It is understood that while certain forms of this invention have been illustrated and described, it is not limited thereto except insofar as such limitations are included in the following claims and allowable functional equivalents thereof.

The invention claimed is:

1. An upper body exercise apparatus, comprising:

a housing defining an interior area;

a spring situated in said housing interior area in a normally unbiased configuration;

a first cable having a first end operatively coupled to said spring and a second end extending away from said housing interior area, an outward movement of said first cable causing said spring to move toward a biased configuration; and a second cable having a first end operatively coupled to said spring and a second end extending away from said housing interior area, an outward movement of said second cable causing said spring to move toward said biased configuration;

a transmission operatively coupled to said spring and to said first and second cables, said transmission being configured such that an outward movement of said first cable without an outward movement said second cable causes all of a resistance of said spring to be transmitted to said first cable, an outward movement of said second cable without an outward movement said first cable causes all of said resistance of said spring to be transmitted to said second cable, and an outward movement of both first and second cables causes said resistance by said spring to be distributed evenly between said first and second cables; and wherein said transmission comprises:

a first gear train situated in said housing interior space and said first end of said first cable is connected to said first gear train;

a second gear train situated in said housing interior space and said first end of said second cable is connected to said second gear train;

wherein said first gear train, said second gear train, and said spring are operatively coupled together such that a rotation of any of said first gear train, said second gear train, and said spring causes simultaneous rotation of each other of first gear train, said second gear train, and said spring; and wherein said spring, said first gear train, and said second gear train include respective sprockets that are coupled to one another with a chain such that a rotation of any of said first gear train, said second gear train, and said spring causes simultaneous rotation of each other of said first gear train, said second gear train, and said spring.

2. The upper body exercise apparatus as in claim 1, further comprising at least one strap coupled to said housing.

3. The upper body exercise apparatus as in claim 1, further comprising a mounting member coupled to an outer surface of said housing with fasteners.

4. The upper body exercise apparatus as in claim 1, further comprising a cable guide assembly separate from said housing.

* * * * *

UNITED STATES PATENT AND TRADEMARK OFFICE

CERTIFICATE OF CORRECTION

PATENT NO. : 8,562,495 B2
APPLICATION NO. : 13/112380
DATED : October 22, 2013
INVENTOR(S) : Ladd et al.

It is certified that error appears in the above-identified patent and that said Letters Patent is hereby corrected as shown below:

Delete the title page and replace with the attached title page.

In the Drawings

Figs. 1-7 should be replaced with the corrected Figs. 1-7 as shown on the attached pages.

Signed and Sealed this
Eleventh Day of February, 2014

Michelle K. Lee

Michelle K. Lee
*Deputy Director of the United States Patent and Trademark Office*

(12) United States Patent
Ladd et al.

(10) Patent No.: US 8,562,495 B2
(45) Date of Patent: Oct. 22, 2013

(54) UPPER BODY EXERCISE APPARATUS FOR STATIONARY BIKE

(75) Inventors: Holly Ladd, Rainbow City, AL (US); David Ladd, Rainbow City, AL (US)

(73) Assignee: HD Enterprises, LLC, Rainbow City, AL (US)

( * ) Notice: Subject to any disclaimer, the term of this patent is extended or adjusted under 35 U.S.C. 154(b) by 226 days.

(21) Appl. No.: 13/112,380

(22) Filed: May 20, 2011

(65) Prior Publication Data

US 2011/0287910 A1 Nov. 24, 2011

Related U.S. Application Data

(60) Provisional application No. 61/347,135, filed on May 21, 2010.

(51) Int. Cl.
*A63B 21/045* (2006.01)
*A63B 21/00* (2006.01)

(52) U.S. Cl.
USPC ..... 482/127; 482/133

(58) Field of Classification Search
USPC ..... 482/51, 54–65, 70, 72, 116, 121–122, 482/126–127, 71, 133
See application file for complete search history.

(56) References Cited

U.S. PATENT DOCUMENTS

| | | | | |
|---|---|---|---|---|
| 4,740,001 | A * | 4/1988 | Torleumke | 280/11.115 |
| 5,226,867 | A * | 7/1993 | Beal | 482/127 |
| 5,304,104 | A * | 4/1994 | Chi | 482/1 |
| 5,584,783 | A | 12/1996 | Hagg et al. | |
| 6,042,516 | A * | 3/2000 | Norton | 482/54 |
| 6,315,701 | B1 * | 11/2001 | Shifferaw | 482/114 |
| 7,524,272 | B2 * | 4/2009 | Bruck et al. | 482/127 |
| 7,695,411 | B2 | 4/2010 | Pandozy | |
| 7,775,943 | B2 | 8/2010 | Vittone et al. | |
| 2002/0025891 | A1 * | 2/2002 | Colosky, Jr. et al. | 482/127 |
| 2005/0159276 | A1 * | 7/2005 | Falcone | 482/123 |
| 2005/0202938 | A1 * | 9/2005 | Goldberg | 482/57 |
| 2008/0119333 | A1 * | 5/2008 | Bowser | 482/62 |
| 2009/0036276 | A1 * | 2/2009 | Loach | 482/72 |
| 2010/0062915 | A1 * | 3/2010 | Lasala | 482/127 |
| 2010/0204023 | A1 * | 8/2010 | Mills et al. | 482/121 |

* cited by examiner

*Primary Examiner* — Oren Ginsberg
*Assistant Examiner* — Andrew S Lo
(74) *Attorney, Agent, or Firm* — Dale J. Ream

(57) ABSTRACT

An upper body exercise apparatus includes a spring positioned in a housing interior area. First and second cables have respective first ends operatively coupled to the spring and respective second ends extending away from the housing. Respective movements of the first and second cables away from the housing cause the spring to move toward a biased configuration. The exercise apparatus includes a transmission configured such that an outward movement of the first cable in the absence of an outward movement of the second cable causes all of the springs resistance to be transmitted to the first cable, an outward movement of the second cable in the absence of movement of the first cable causes all of the spring's resistance to be transmitted to the second cable, and an outward movement by both cables causes the spring's resistance to be distributed equally between the first and second cables.

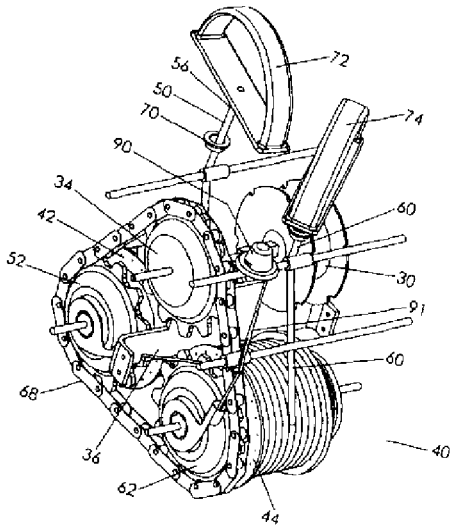

4 Claims, 7 Drawing Sheets